US007921826B2

(12) United States Patent
Kobayashi et al.

(10) Patent No.: US 7,921,826 B2
(45) Date of Patent: Apr. 12, 2011

(54) FUEL SUPPLY DEVICE FOR ENGINE

(75) Inventors: Nobu Kobayashi, Osaka (JP); Hajimu Imanaka, Osaka (JP); Mitsuyoshi Kawarabayashi, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 141 days.

(21) Appl. No.: 12/377,507

(22) PCT Filed: Jul. 23, 2007

(86) PCT No.: PCT/JP2007/064451

§ 371 (c)(1),
(2), (4) Date: Apr. 3, 2009

(87) PCT Pub. No.: WO2008/020529

PCT Pub. Date: Feb. 21, 2008

(65) Prior Publication Data

US 2010/0275882 A1 Nov. 4, 2010

(30) Foreign Application Priority Data

Aug. 16, 2006 (JP) ..... 2006-222083

(51) Int. Cl.
*F02M 57/02* (2006.01)

(52) U.S. Cl. ..... 123/446; 123/447

(58) Field of Classification Search ..... 123/446, 123/447, 456, 457, 458, 510, 511, 198 D; 417/295–304, 40, 441
See application file for complete search history.

(56) References Cited

U.S. PATENT DOCUMENTS

| | | | | |
|---|---|---|---|---|
| 5,529,042 | A * | 6/1996 | Augustin et al. | 123/456 |
| 5,678,521 | A * | 10/1997 | Thompson et al. | 123/447 |
| 6,058,912 | A * | 5/2000 | Rembold et al. | 123/516 |
| 6,135,090 | A * | 10/2000 | Kawachi et al. | 123/446 |
| 6,516,784 | B1 * | 2/2003 | Shingu | 123/450 |
| 6,694,950 | B2 * | 2/2004 | Djordjevic | 123/446 |
| 6,953,025 | B2 * | 10/2005 | Takahashi | 123/497 |
| 2003/0098016 | A1 * | 5/2003 | Rembold et al. | 123/457 |

(Continued)

FOREIGN PATENT DOCUMENTS

JP 2000-356156 12/2000

(Continued)

OTHER PUBLICATIONS

International Search Report for International Application No. PCT/JP2007/064451, Japanese Patent Office, mailed Aug. 21, 2007, 1 pg.

*Primary Examiner* — Thomas N Moulis
(74) *Attorney, Agent, or Firm* — Sterne, Kessler, Goldstein & Fox, P.L.L.C.

(57) ABSTRACT

To make it possible to pump a fuel from a supply pump into an accumulator, even when a pressure control means provided with a pressurized fuel pathway is out of action. In a fuel supply system of an engine, which is provided with pressure control means controlling a fuel pressure in an accumulator, on the pressurized fuel pathway delivering the fuel from a feed pump via a supply pump having a plurality of plungers into the accumulator, at least one pressurized fuel pathway is not provided with the pressure control means and the other pressurized fuel pathways are provided with the pressure control means, out of the plurality of pressurized fuel pathways delivering the fuel from the feed pump via plurality of plungers into the accumulator.

2 Claims, 6 Drawing Sheets

U.S. PATENT DOCUMENTS

| | | | | |
|---|---|---|---|---|
| 2008/0078362 | A1* | 4/2008 | Tian | 123/446 |
| 2009/0084355 | A1* | 4/2009 | Vogt et al. | 123/447 |
| 2009/0145402 | A1* | 6/2009 | Sano | 123/447 |
| 2009/0291006 | A1* | 11/2009 | Inoue et al. | 417/441 |
| 2009/0320796 | A1* | 12/2009 | Kojima et al. | 123/447 |

FOREIGN PATENT DOCUMENTS

| | | |
|---|---|---|
| JP | 2001-304067 | 10/2001 |
| JP | 2002-349389 | 12/2002 |
| JP | 2005-351135 | 12/2005 |

* cited by examiner

FUEL SUPPLY DEVICE FOR ENGINE

BACKGROUND OF THE INVENTION

1. Field of the Invention

The present invention relates to a fuel supply system of an engine provided with a pressure control means which controls a fuel pressure in an accumulator, on a pressurized fuel pathway sending pressurized fuel from a feed pump via a supply pump equipped with a plurality of plungers to the accumulator.

2. Related Art

Conventionally, there are well-known supply pumps, comprising a plunger for sending highly-pressurized fuel by pressurizing in a pressurizing chamber to an accumulator, so as to supply the fuel from a fuel supply system of an engine and a pressure control means which controls a fuel pressure in the accumulator by adjusting inhalation volumes of the fuel to the pressurizing chamber or pressurized volumes of the fuel from the pressurizing chamber by the plunger, wherein the inhalation volume of the fuel to the pressurizing chamber or the pressurized volume of the fuel from the pressurizing chamber is adequately adjustable by the pressure control means, so as to control the fuel pressure in the accumulator to a given pressure (for example, see JP2000-356156).

However, in the conventional fuel supply system, the inhalation volumes of the fuel to the pressurizing chamber or the pressurized volumes of the fuel from the pressurizing chamber by the respective plungers are adjusted using one pressure control means, and in this case, if the pressure control means is out of action due to a failure or the like, the fuel can not be supplied to the pressurizing chamber, thereby causing the problem on which the pressurized fuel can not be sent from any pressurizing chamber to the accumulators When this problem is due to the failure of the pressure control means itself, the fuel supply system can be constructed so that pressure control means are provided based on the number of plungers, and the inhalation volumes of the fuel to every pressurizing chamber or the pressurized volumes of the fuel from every pressurizing chamber by the respective plungers are independently adjusted using the respective pressure control means, whereby some of the fuel can be sent from the pressurizing chambers to the accumulators, unless all pressure control means break down. However, due to the above construction, the number of components in the supply pump are increased, thereby causing another problem of increasing the cost.

SUMMARY OF THE INVENTION

In a fuel supply system of an engine, which is provided with pressure control means controlling a fuel pressure in an accumulator, on the pressurized fuel pathway delivering the fuel from a feed pump via a supply pump having plurality of plungers into the accumulator, a fuel supply system of an engine of the present invention is constructed so that at least one pressurized fuel pathway is not provided with the pressure control means and the other pressurized fuel pathways are provided with the pressure control means, out of the plurality of pressurized fuel pathways delivering the fuel from the feed pump via the plurality of plungers into the accumulator.

The fuel supply system of the engine of the present invention is constructed so that the pumping volumes on the pressurized fuel pathway without the pressure control means are less than those on the pressurized fuel pathway with the pressure control means.

The fuel supply system of the engine of the present invention is constructed so that the pumping volumes on the pressurized fuel pathway without the pressure control means are less than those of the fuel needed while idle driving.

The fuel supply system of the engine of the present invention is constructed so that the pressurized fuel pathway without the pressure control means is interposed on the intake side pathway to the pressurizing chamber of the plunger with a check valve, and a bypass pathway, which bypasses the check valve, is provided between the pressurizing chamber of the plunger and the discharge side of the feed pump.

The fuel supply system of the engine of the present invention is constructed so that check valves are interposed on the intake side pathways to the pressurizing chambers of the respective plungers, and bypass pathways bypassing the check valves are provided between the pressurizing chambers of the respective plungers and the discharge sides of the feed pumps.

In a fuel supply system of an engine, which supplies fuel from a feed pump via a pressure control means to a supply pump having a plurality of plungers and pumps them from the supply pump into an accumulator, the fuel supply system of an engine of the present invention is constructed so that a bypass pathway bypassing the pressure control means are provided between the feed pump and the supply pump and the bypass pathway is provided with an on-off valve.

In the fuel supply system of the engine of the present invention, which is provided with pressure control means controlling a fuel pressure in an accumulator, on the pressurized fuel pathway delivering the fuel from a feed pump via a supply pump having a plurality of plungers into the accumulator, at least one pressurized fuel pathway is not provided with the pressure control means and the other pressurized fuel pathways are provided with the pressure control means, out of a plurality of pressurized fuel pathways delivering the fuel from the feed pump via the plurality of plungers into the accumulator, so that even when the pressure control means is out of action due to the fault or the like, the fuel can be pumped from the supply pump via the pressurized fuel pathway without the pressure control means into the accumulator by the supply pump, thereby driving without stopping the engine. Accordingly, the pumping volume of the fuel can be adjusted using one pressure control means, thereby reducing the number of components.

In the fuel supply system of the engine of the present invention, which is constructed so that the pumping volumes on the pressurized fuel pathway without the pressure control means are less than those on the pressurized fuel pathway with the pressure control means, the adjustable ranges in the inhalation volumes of the fuel into the pressurizing chamber or the pumping volumes of the fuel from the pressurizing chamber by the pressure control means can be expanded, thereby reducing the losses of the pressurized fuel into the accumulator 2 when the injection quantities from the injectors are small. The escaped volumes of the fuel from the accumulator can be lowered, thereby minimizing an escape valve provided with the accumulator.

In the fuel supply system of the engine of the present invention, which is constructed so that the pumping volumes on the pressurized fuel pathway without the pressure control means are less than those of the fuel needed while idle driving, the fuel pressure in the accumulator can be easily controlled only by the pressure control means, without the need for the escape valve escaping the fuel from the accumulator, thereby reducing the number of components. The fuel need not to be escaped from the accumulator even when idle driving having lower injection quantity from the injector, thereby reducing the losses of the pressurized fuel.

In the fuel supply system of the engine of the present invention, the pressurized fuel pathway without the pressure control means is interposed on the intake side pathway to the pressurizing chamber of the plunger with a check valve, and a bypass pathway, which bypasses the check valve between the pressurizing chamber of the plunger and the discharge side of the feed pump, is provided, thereby assuredly inhaling the fuel into the pressurizing chamber even at low rotation of the engine so as to ensure a stable starting performance. Even when the pressure control means is out of action due to the fault or the like, some the fuel can be inhaled into the pressurizing chamber, thereby driving the engine.

In the fuel supply system of the engine of the present invention, the check valves are provided on the intake side pathways to the pressurizing chambers of the respective plungers and the bypass pathways bypassing the check valves between the pressurizing chambers of the respective plungers and the discharge sides of the feed pumps are provided, thereby assuredly inhaling the fuel into all pressurizing chambers even at low rotation of the engine, so as to ensure favorable starting performance.

In the fuel supply system of the engine of the present invention, which supplies the fuel from the feed pump via the pressure control means to the supply pump having a plurality of plungers and pumps them from the supply pump into the accumulator, the bypass pathway bypassing the pressure control means are provided between the feed pump and the supply pump and the bypass pathway is provided with an on-off valve, whereby some fuel can be sent from the supply pump to the accumulator by opening the on-off valve, even when the pressure control means is out of action due to the fault or the like, thereby driving the engine. Accordingly, the supply pump can be constructed so that the inhalation volumes of the fuel to the pressurizing chamber or the pressurized volumes of the fuel from the pressurizing chamber by every plunger are adjusted using one pressure control means, thereby lowering the number of components.

DETAILED DESCRIPTION OF THE INVENTION

An entire construction of a fuel supply system of an engine equipped with a conventional supply pump will be described.

Figure 5:
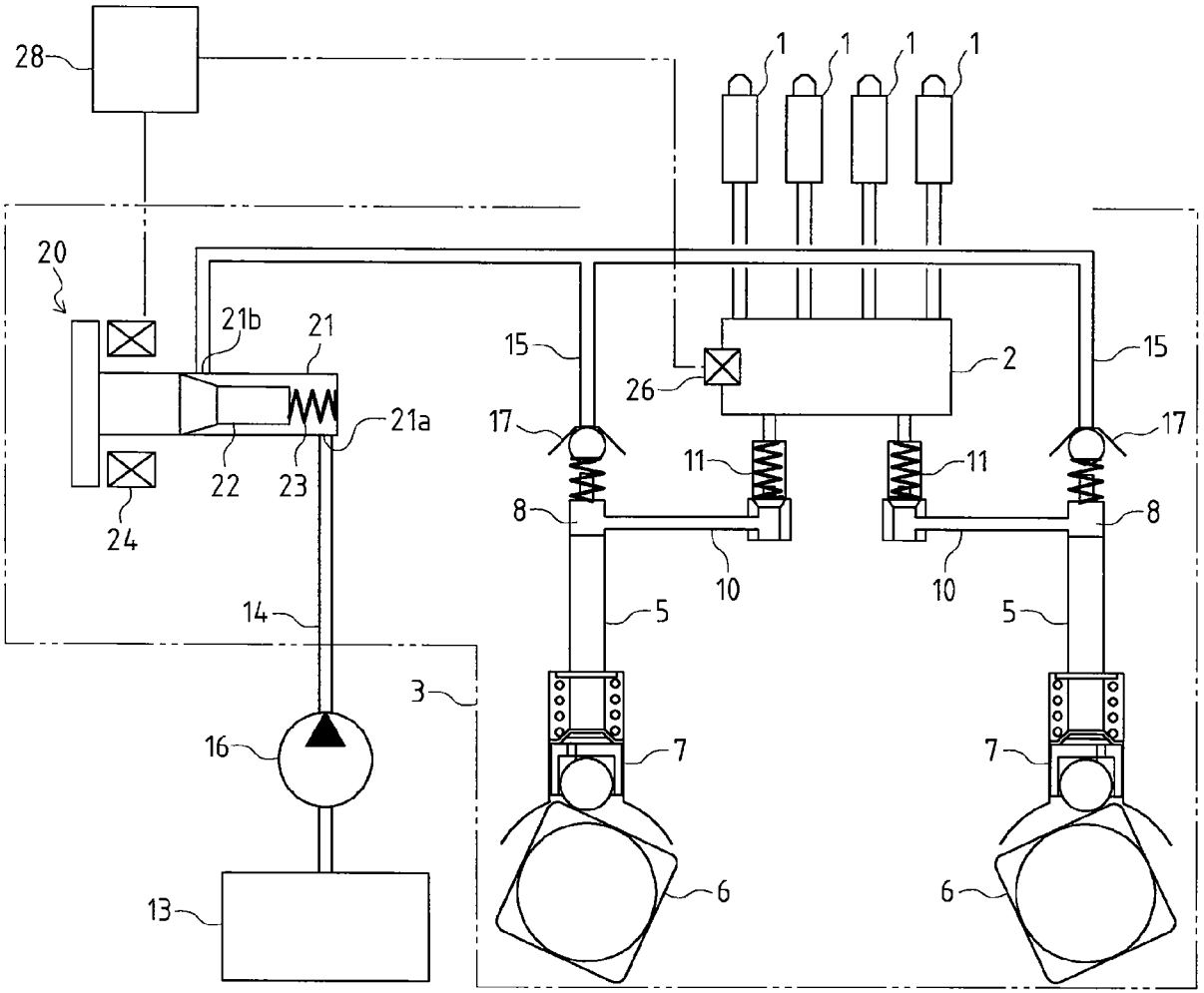
FIG. 5 is a diagram of an entire construction of a fuel supply system equipped with a conventional supply pump.

As shown in FIG. 5, the fuel supply system is comprised of plurality of injectors 1,1,1,1, an accumulator 2 which stores highly-pressurized fuel so as to supply them to the respective injectors 1,1,1,1, a supply pump 3 which pressurizes the fuel so as to send them to the accumulator 2. The supply pump 3 includes a plurality of, e.g., two in the present embodiment, plungers 5,5, and reciprocates the respective plungers 5,5 via tappets 7,7 by rotations of cams 6,6, so as to inhale the fuel into pressurizing chambers 8,8 and pressurize them, thereby sending the highly-pressurized fuel to the accumulator 2.

In the supply pump 3, the respective pressurizing chambers 8 are connected to the accumulator 2 via discharge side pathways 10 as parts of pressurized fuel pathways, so that the highly-pressurized fuel through the discharge side pathways 10 can be sent from the pressurizing chambers 8 via check valves 11 to the accumulator 2. The respective pressurizing chambers 8 are also connected to the discharge side of a feed pump 16 via the respective divergent pathways 15 and an intake side pathway 14 as parts of pressurized fuel pathways, so that the fuel pumped from a fuel tank 13 by the feed pump 16 can be inhaled into the pressurizing chambers 8 via a pressure control means and check valves 17 provided with the pressurized fuel pathways.

Figure 6:
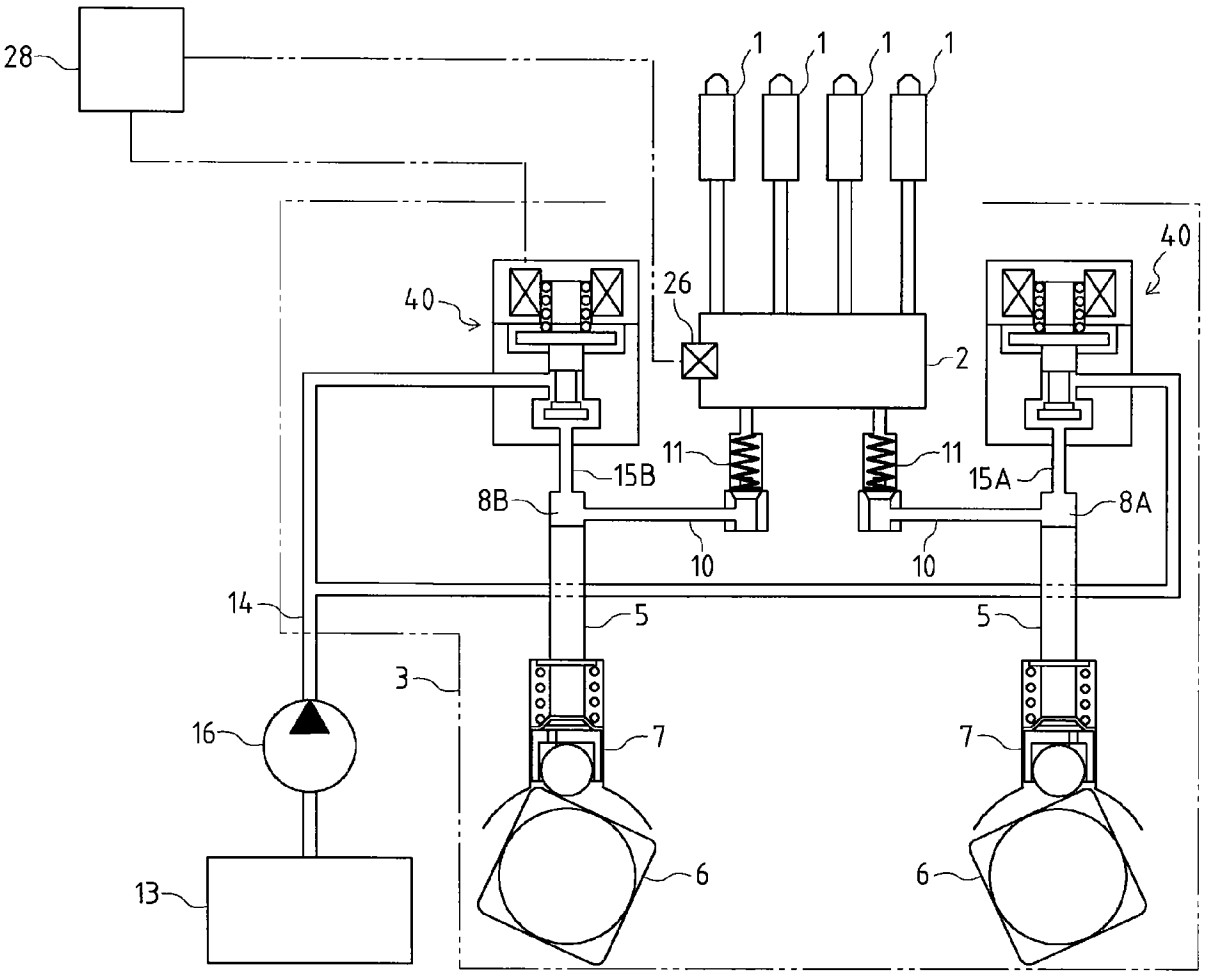
FIG. 6 is a diagram of an entire construction of a fuel supply system equipped with a conventional supply pump according to another embodiment.

The pressure control means controls the fuel pressure in the accumulator 2 and is provided with divergent pathways 15 connected to the pressurizing chambers 8. The pressure control means, for example, as the present embodiment, is an inhalation volume control valve 20 which adjusts the inhalation volume of the fuel inhaled into the pressurizing chamber 8 so as to control the fuel pressure in the accumulator 2 to the given pressure, which is constructed so that it includes a cylinder chamber 21, a piston 22 which can reciprocate in the cylinder chamber 21, a spring 23 which biases the piston 22 in one direction, a solenoid 24 which moves the piston 22 in the direction opposite to the biasing direction of the spring 23 or the like. In this regard, the pressure control means is not limited to the inhalation volume control valve 20, and may be a pressure control valve 40 as shown in FIG. 6.

The inhalation volume control valve 20 includes two ports 21*a*, 21*b* in the cylinder chamber 21, one port 21*a* of which is connected to the intake side of the fuel in the intake side pathway 14, the other port 21*b* of which is connected to the discharge side of the fuel in the intake side pathway 14. With respect to both ports 21*a*, 21*b*, the intake side port 21*a* is disposed so that the opening degree thereof (the opening space) is not changed regardless of the movement zone of the piston 22, and the discharge side port 21*b* is disposed so that the opening degree thereof (the opening space) is changeable based on the movement zone of the piston 22.

When the solenoid 24 is not energized, the piston 22 is biased by the spring 23 so as to be moved to the position where the intake side port 21*a* and the discharge side port 21*b* are fully opened. Meanwhile, when the solenoid 24 is energized, the piston 22 is moved to the direction opposite to the biasing direction against the biasing force of the spring 23, in accordance with the excitation power of the solenoid 24, so as to be moved to the position where the intake side port 21*a* is fully opened and the discharge side port 21*b* is only partially or fully closed.

Thus, the movement zone of the piston 22 to the discharge side port 21*b* is changed by changing the energization state of the solenoid 24, so that the opening degree of the discharge side port 21*b* is controlled, so as to adjust the inflow volume of the fuel flowing in the inhalation volume control valve 20, i.e., the volume of flow of the fuel into the pressurizing chambers 8. In this regard, the opening degree of the discharge side port 21*b* is increased as the piston 22 moves to the left direction in FIG. 5, and it is decreased as the piston 22 moves to the right direction in FIG. 5 and is finally reduced to almost zero. In other words, the discharge side port 21*b* become closed.

The solenoid 24 is connected to a controller 28 with a pressure sensor 26 detecting the fuel pressure in the accumulator 2. The controller 28 changes the energization state of the solenoid 24 based on the detection value of the fuel pressure detected by the pressure sensor 26 and controls the opening degree of the discharge side port 21*b*, thereby controlling the fuel pressure in the accumulator 2 to the given pressure, by increasing or decreasing the inhalation volume of the fuel into the pressurizing chambers 8. The respective injectors 1,1,1,1 are connected to the controller 28.

The accumulator 2 is provided with an escape valve (not show). The escape valve is constructed so that it is open when the fuel pressure in the accumulator 2 detected by the pressure sensor 26 is higher than the given pressure and escapes the fuel from the accumulator 2 through the discharge pathway to the fuel tank 13 so as to lower the fuel pressure in the accumulator 2, thereby controlling the fuel pressure in the accumulator 2 to the given pressure with the inhalation volume control valve 20.

In this way, in the fuel supply system, the fuel, which is pumped from the fuel tank 13 by the feed pump 16 so as to be sent to the supply pump 3, are adjusted to the adequate inhalation volume via the inhalation volume control valve 20 controlled by the controller 28, and are inhaled into the respective pressurizing chambers 8, so as to be highly pressurized by the plungers 5 connected to the respective pressurizing chambers 8. The fuel, which is sent from the respective pressurizing chambers 8 to the accumulator 2 by the plungers 5 and is adjusted to the given pressure in the accumulator 2 by the inhalation volume control valve 20 so as to be stored there, are supplied to the respective injectors 1,1,1,1, so as to be injected from the respective injectors 1,1,1,1 to a fuel chamber by the controller 28.

Incidentally, herein, the fuel pressure in the accumulator 2 is controlled by adjusting the inhalation volume of the fuel into the pressurizing chambers 8 via the inhalation volume control valve 20, which is provided on the intake side pathway 14 as the pressure control means, but the fuel pressure can be controlled by adjusting the pumping volumes of the fuel from the pressurizing chambers 8 using the pressure control means provided with the discharge side pathways 10. The inhalation volumes of the fuel into the respective pressurizing chambers 8 by the plungers 5 may be collectively adjusted by one inhalation volume control valve 20, or they may be independently adjusted in every pressurizing chamber 8, by the respective inhalation volume control valve 20 provided in accordance with the numbers of the respective pressurizing chambers 8.

However, the above-mentioned supply pump 3 in the fuel supply system is constructed so that it changes the pumping volumes of the fuel from the pressurizing chambers 8 via the plungers 5, by adjusting the inhalation volumes of the fuel into the pressurizing chambers 8 through the respective plungers 5 via the pressure control means, i.e., the inhalation volume control valve 20 in the present embodiment, so as to keep the fuel pressure in the accumulator 2 to the given pressure. In this case, when the inhalation volumes of the fuel into the pressurizing chambers 8 and the pumping volumes of the fuel from the pressurizing chambers 8 by each of plurality of plungers 5 are adjusted using one inhalation volume control valve 20, if the inhalation volume control valve 20 is out of action due to the fault or the like, it fails to inhale the fuel into the pressurizing chambers 8, thereby causing the problem on which the fuel can not pressurized to be sent from any pressurizing chambers 8 to the accumulator 2.

If the problem is due to the fault of the inhalation volume control valve 20 itself, the supply pump 3 is constituted in such a way that the inhalation volume control valves 20 are provided according to the numbers of the plungers 5 and the inhalation volumes of the fuel into every pressurizing chamber 8 through the respective plungers 5 via the respective inhalation volume control valves 20 or the pumping volumes of the fuel from every pressurizing chamber 8 are independently controlled, so as to pump some of the fuel from the pressurizing chambers 8 to the accumulator 2, unless all inhalation volume control valves 20 break down, thereby causing another problems of increasing the number of components of the supply pump 3 and leading to increase in cost.

Consequently, in the present invention, the supply pump 3 is constituted as follows, in order to solve the above problems. Next, the concrete structure thereof will be described with reference to the inhalation volume control valve 20 as the pressure control means. Incidentally, in the following embodiment, the pressure control means is not limited to the inhalation volume control valve 20 and may be a pressure control valve 40 as shown in FIG. 6.

Embodiment 1

Figure 1:
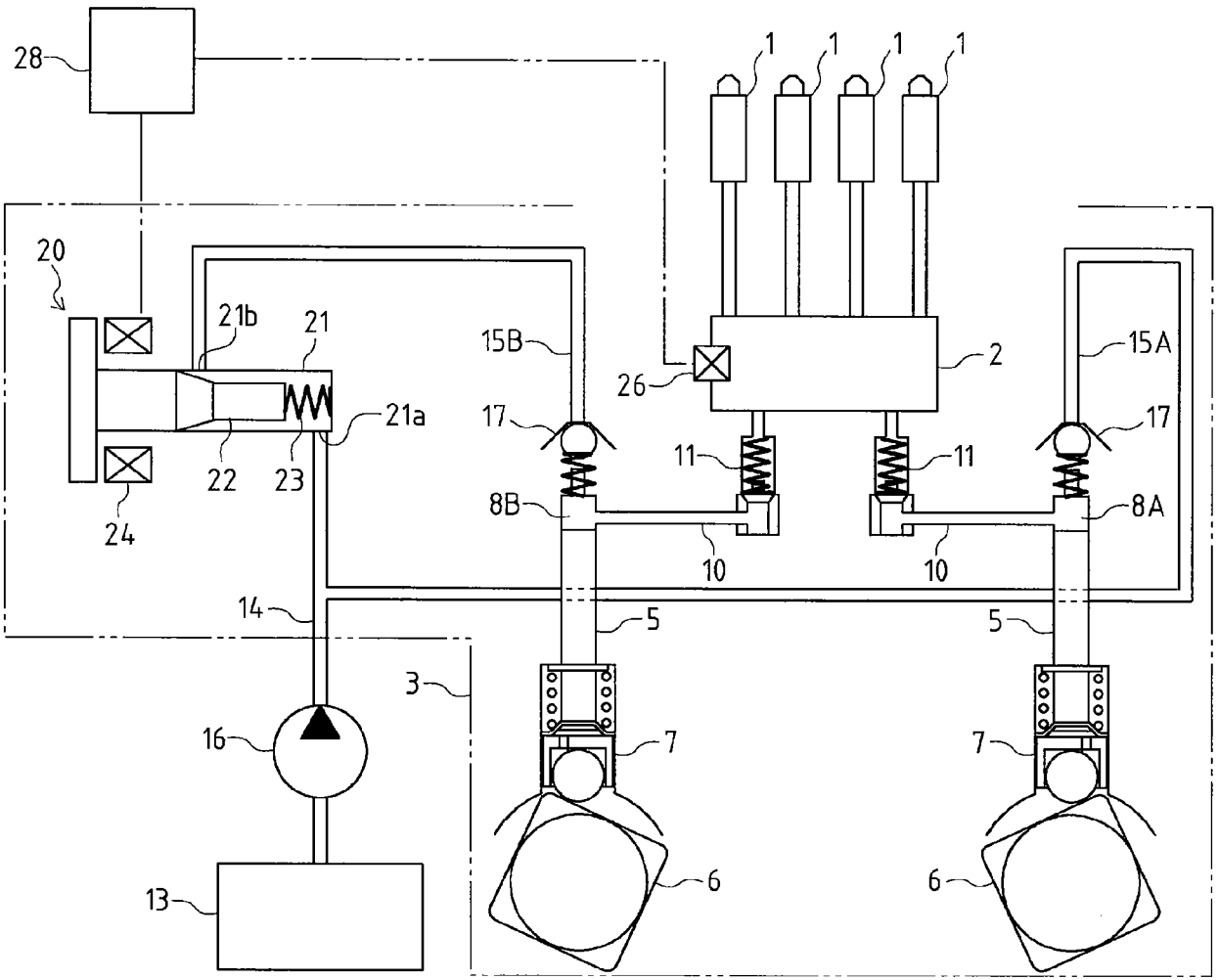
FIG. 1 is a diagram of an entire construction of a fuel supply system equipped with a supply pump according to an embodiment of the present invention.

As shown in FIG. 1, the supply pump 3 is constructed so that it includes a plurality of plungers 5 and it adjusts the inhalation volumes of the fuel into the pressurizing chambers 8 on the top of the respective plungers 5 except at least one plunger 5 using one respective inhalation volume control valves 20. When two plungers 5,5 as the present embodiment are utilized, a pressurizing chamber 8A, which pressurizes the fuel through one of the plungers 5, is connected to the intake side pathway 14 and the divergent pathway 15A via the check valve 17 without the inhalation volume control valves 20, and a pressurizing chamber 8B, which pressurizes the fuel through the other of the plungers 5, is connected to the intake side pathway 14 and the divergent pathway 15B via the check valve 17 and the inhalation volume control valves 20

Specifically, in the supply pump 3, which includes plurality of plungers 5 pumping the highly-pressurized fuel by pressurizing in the pressurizing chambers 8 to be under high pressure into the accumulator 2, the inhalation volume control valves 20 controlling the fuel pressure in the accumulator 2 to the given pressure by adjusting the inhalation volumes of the fuel into the pressurizing chambers 8 through the plungers 5 or the pumping volumes of the fuel from the pressurizing chambers 8, the inhalation volume control valves 20 is provided on the pressurized fuel pathway, so that it does not control the inhalation volumes of the fuel into the pressurizing chambers 8 through at least one plunger 5 or the pumping volumes of the fuel from the pressurizing chambers 8 but the inhalation volumes of the fuel into the pressurizing chambers 8 through the other plungers 5 or the pumping volumes of the fuel from the pressurizing chambers 8.

Thus, in the supply pump 3, a total volume of the fuel in the fuel tank 13 pumped from the feed pump 16 are inhaled into at least one pressurizing chamber 8A through the plunger 5, and only the inhalation volumes adjusted by the inhalation volume control valves 20 can be inhaled into the other pressurizing chamber 8B.

As described above, in the fuel supply system of the engine equipped with the inhalation volume control valve 20 as the pressure control means controlling the fuel pressure in the accumulator 2, on the pressurized fuel pathway delivering the fuel from the feed pump 16 via the supply pump 3 including plurality of plungers 5,5 into the accumulator 2, out of the plurality of pressurized fuel pathways delivering the fuel from the feed pump 16 via the plurality of plungers 5,5 into the accumulator 2, the inhalation volume control valves 20 is not provided on at least one pressurized fuel pathway, and the inhalation volume control valves 20 is provided on the other pressurized fuel pathway, so that, even when the inhalation volume control valves 20 is out of action due to the fault or the like, some fuel can be delivered from the pressurizing chamber 8A of the supply pump 3 into the accumulator 2, thereby driving the engine. Accordingly, the inhalation volumes of the fuel into the pressurizing chambers 8 though every plunger 5 or the pumping volumes of the fuel from the pressurizing chambers 8 need not to be independently adjusted using each of the inhalation volume control valves 20, which is provided based on the number of the plungers 5, considering the inoperative of the inhalation volume control valves 20, whereby the supply pump 3 can be constituted so as to be adjusted using one inhalation volume control valve 20, so as to reduce the number of components.

With respect to the inhalation volumes of the fuel into the pressurizing chambers 8A, 8B by the plungers 5 through the pressurized fuel pathways or the pumping volumes of the fuel from the pressurizing chambers 8A, 8B, the above-mentioned supply pump 3 is constituted so that the volumes on the side (the side of the pressurizing chamber 8A) without the adjustment by the inhalation volume control valves 20 are less than those on the side (the side of the pressurizing chamber 8B) with the adjustment by the inhalation volume control valves 20.

As previously described, the supply pump 3 is constructed in such a way that the pumping volumes of the pressurized fuel pathway without the inhalation volume control valves 20 are less than those of the pressurized fuel pathway with the inhalation volume control valves 20, whereby the adjustable ranges in the inhalation volumes of the fuel into the pressurizing chamber 8B through the plunger 5 via the inhalation volume control valves 20 or the pumping volumes of the fuel from the pressurizing chamber 8B can be expanded, thereby reducing the losses of the pressurized fuel into the accumulator 2 when the injection quantities from the injectors 1,1,1,1 are small in amount. The escaped volumes of the fuel from the accumulator 2 can be lowered, thereby minimizing an escape valve provided with the accumulator 2.

With respect to the inhalation volumes of the fuel into the pressurizing chambers 8A, 8B by the plungers 5 through the pressurized fuel pathways or the pumping volumes of the fuel from the pressurizing chambers 8A, 8B, the above-mentioned supply pump 3 is constituted so that the volumes on the side (the side of he pressurizing chamber 8A) without the adjustment by the inhalation volume control valves 20 are less than the inhalation volumes of the fuel into the pressurizing chambers 8 by the plungers 5 or the pumping volumes of the fuel from the pressurizing chambers 8 needed when idle driving.

In this way, the supply pump 3 is constituted so that the pumping volumes on the pressurized fuel pathway without the inhalation volume control valve 20 is less than those of the fuel needed when idle driving, so that the fuel pressure in the accumulator 2 is easily controlled only by adjusting the inhalation volumes of the fuel into the pressurizing chamber 8B through the plunger 5 via the inhalation volume control valves 20 or the pumping volumes of the fuel from the pressurizing chamber 8B, without the need for the escape valve so as to escape the fuel in the accumulator 2, thereby decreasing the number of components. Even while idle driving having lower injection quantities from the injectors 1,1,1,1, the fuel need not to be escaped from the accumulator 2, thereby reducing the losses of the pressurized fuel.

In the supply pump 3, while engine starting having lower rotation of the engine, the intake side pathway 14 and the divergent pathway 15 have lower fuel pressures, and the fuel from the fuel tank 13 pumped by the feed pump 16 can not be inhaled from the divergent pathways 15 via the check valves 17 into the pressurizing chambers 8, thereby leading to the deterioration of the starting performance. In this respect, the supply pump 3 can be constituted as follows, so as to prevent the deterioration of the starting performance.

Figure 2:
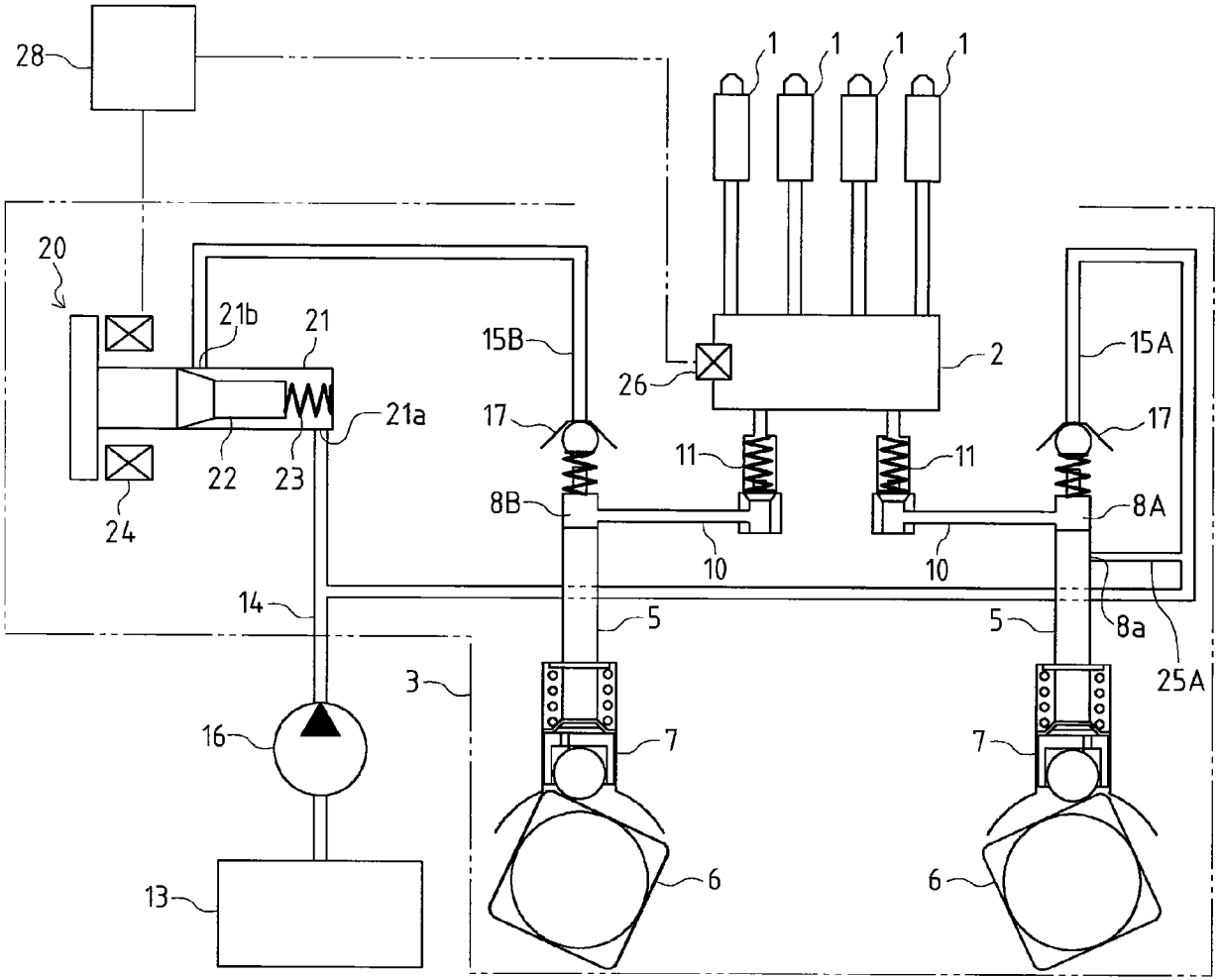
FIG. 2 is a diagram of another inhaling port provided with a pressurizing chamber on one side of the supply pump in FIG. 1.

As the present embodiment, when the intake side pathway 14 has the inhalation volume control valve 20 and the fuel pressure in the accumulator 2 is kept to the given pressure by adjusting the inhalation volumes of the fuel into the pressurizing chamber 8B through the respective plungers 5 via the inhalation volume control valve 20, as shown in FIG. 2, the supply pump 3 is constructed so that the pressurizing chamber 8A without adjusting the inhalation volumes of the fuel by the inhalation volume control valve 20 is connected to the intake side pathway 14 via the check valve 17 on the divergent pathway 15 as mentioned above, and is provided with another fuel inhaling port 8*a* so as to connect a bypass pathway 25A bifurcated from the intake side pathway 14. In other words, the supply pump 3 is constructed so that the discharge side of the feed pump 16 is communicated with the pressurizing chamber 8A via the bypass pathway 25A.

In the pressurized fuel pathway without the inhalation volume control valve 20, the check valve 17 is interposed between the pressurizing chamber 8A connected to the plunger 5 and the intake side pathway 14 as well as the bypass pathway 25A bypassing the check valve 17 is provided between the pressurizing chamber 8A connected to the plunger 5 and the discharge side of the feed pump 16, so that, even when the pumping volumes pumped against the drag of spring of the check valve 17 are unstable due to the low pumping pressure at low rotation of the engine, the fuel can be assuredly inhaled into the pressurizing chamber 8A by connecting the bypass pathway 25A, thereby ensuring the stable starting performance. Even if the inhalation volume control valve 20 is out of action due to the fault or the like, some fuel can be inhaled into the pressurizing chamber 8, thereby driving the engine.

Figure 3:
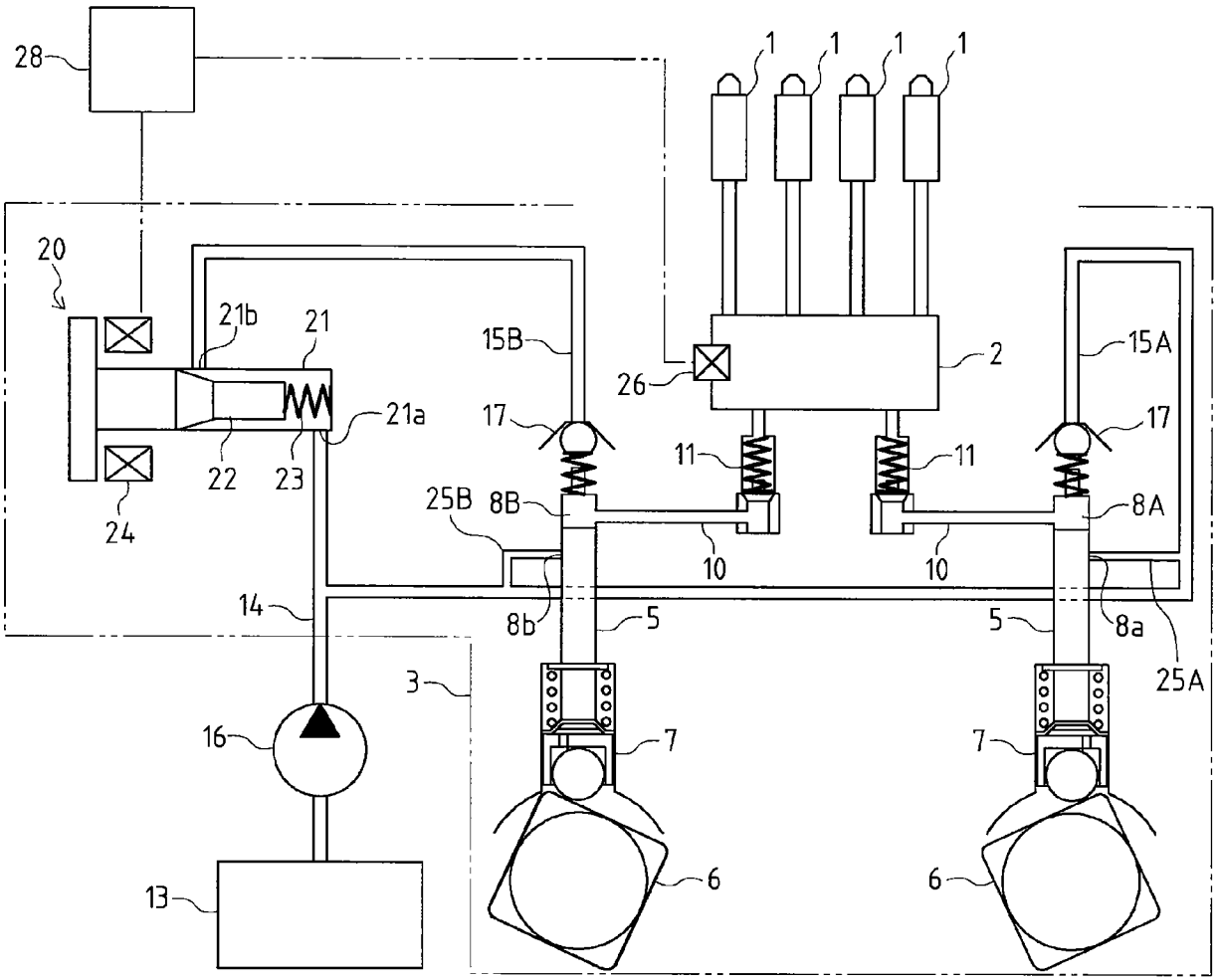
FIG. 3 is a diagram of another inhaling port provided with a pressurizing chamber on both sides of the supply pump in FIG. 1.

As shown in FIG. 3, the supply pump 3 can be constituted so that the pressurizing chamber 8B with adjusting the inhalation volumes of the fuel by the inhalation volume control valve 20 as well as the pressurizing chamber 8A without adjusting the inhalation volumes of the fuel by the inhalation volume control valve 20 is connected to the intake side pathway 14 via the check valve 17 on the divergent pathway 15 as mentioned above, and is provided with another fuel inhaling port 8*b*, so as to connect another bypass pathway 25B bifurcated from the intake side pathway 14. In other words, the supply pump 3 is constructed so that the discharge side of the feed pump 16 is communicated with the pressurizing chamber 8A, 8B via the bypass pathway 25A, 25B. In this case, the fuel can be assuredly inhaled into all pressurizing chamber 8A, 8B even at low rotation of the engine, thereby ensuring favorable starting performance.

Embodiment 2

Figure 4:
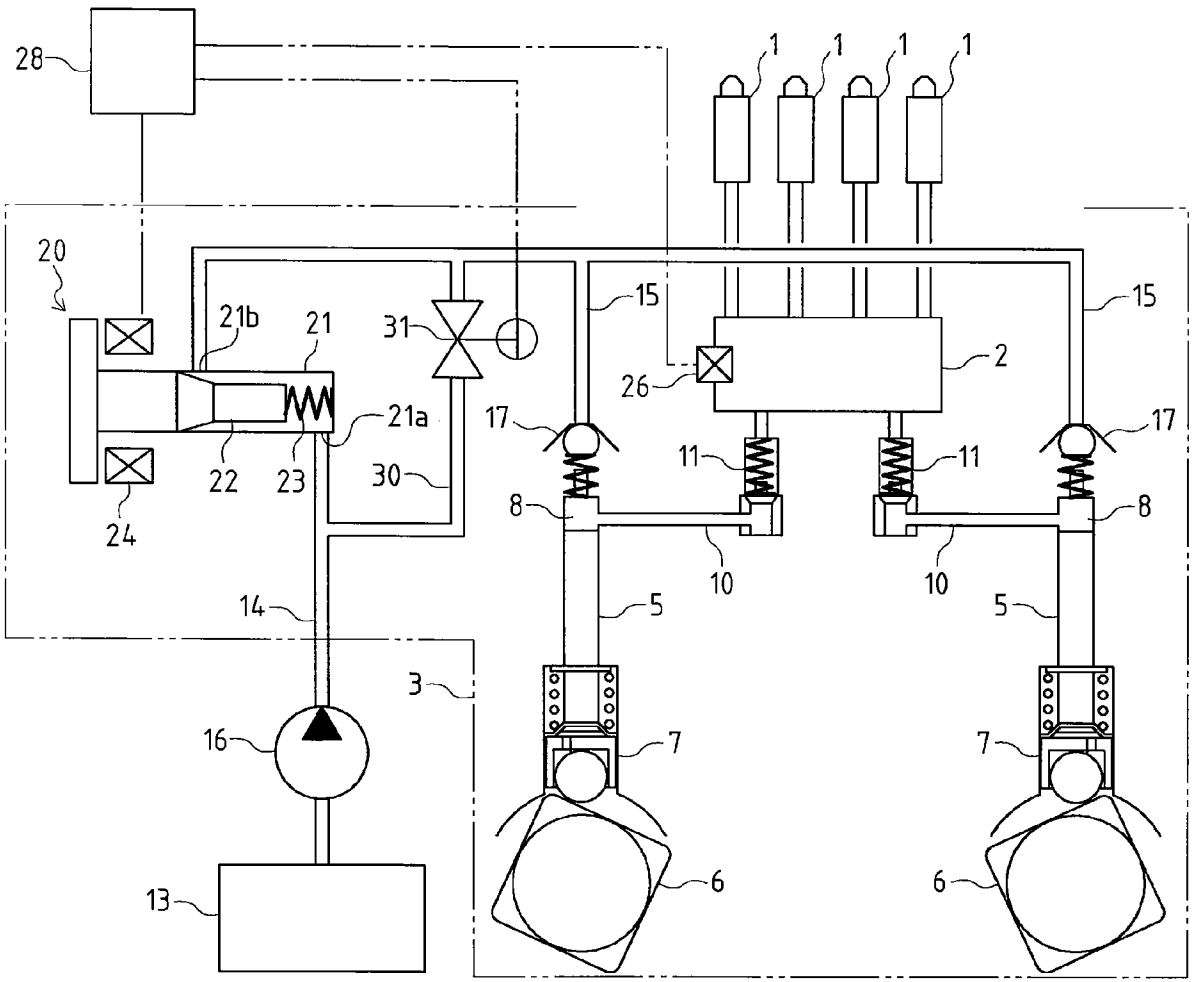
FIG. 4 is a diagram of an entire construction of a fuel supply system equipped with a supply pump according to another embodiment.

As shown in FIG. 4, the supply pump 3 is constructed so that it includes plurality of plungers 5,5 and adjust the inhalation volumes of the fuel into the pressurizing chambers 8 through the respective plungers 5 via one inhalation volume control valve 20. The intake side pathway 14, which is provided with inhalation volume control valve 20 between the feed pump 16 and the supply pump 3, is provided with a bypass pathway 30 bypassing the inhalation volume control valve 20, and the bypass pathway 30 is provided with an on-off valve 31 so as to open and close it. The on-off valve 31 is comprised of a solenoid valve or the like, and the solenoid thereof is connected to the controller 28. An operating means such as a switch changing over the switching condition of the on-off valve 31 is connected to the controller 28, and the switching of the on-off valve 31 is controlled by the operation of the operating means so as to open the bypass pathway 30.

Therefore, when the controller 28 evaluates that an aberrance is caused based on the detected value from the pressure sensor 26 or the like and the inhalation volume control valve 20 is out of action due to the fault or the like, the controller 28 controls the on-off valve 31 to open, so as to pump the fuel from the supply pump 3 into the accumulator 2, thereby driving the engine. Accordingly, the inhalation volumes of the fuel into the pressurizing chambers 8 though every plunger 5 or the pumping volumes of the fuel from the pressurizing chambers 8 need not to be independently adjusted using each of the inhalation volume control valves 20, which is provided based on the number of the plungers 5, considering the inoperative of the inhalation volume control valve 20, whereby the supply pump 3 can be constituted so as to be adjusted using one inhalation volume control valve 20, so as to reduce the number of components.

INDUSTRIAL APPLICABILITY

The fuel supply system of the engine according to the present invention is industrially effective, in that it can pump the fuel from the supply pump into the accumulator even when the pressure control means provided with the pressurized fuel pathway is out of action.

The invention claimed is:

1. A fuel supply system of an engine provided with a pressure control means controlling a fuel pressure of an accumulator, on a plurality of pressurized fuel pathways delivering the fuel from a feed pump via a supply pump having a plurality of plungers into the accumulator, wherein, the pressure control means is not provided on at least one pressurized fuel pathway and the pressure control means is provided on the other pressurized fuel pathways, of the plurality of pressurized fuel pathways delivering the pressurized fuels from the feed pump via the plurality of plungers into the accumulator, wherein the pressurized fuel pathway without the pressure control means is interposed on the intake side pathway to the pressurizing chamber of the plunger with a check valve, and a bypass pathway, which bypasses the check valve, is provided between the pressurizing chamber of the plunger and the discharge side of the feed pump.

2. The fuel supply system of the engine as set forth in claim 1, wherein check valves are provided on the intake side pathways to the pressurizing chambers of the respective plungers, on the other pressurized fuel pathways and bypass pathways bypassing the check valves are provided between the pressurizing chambers of the respective plungers and the discharge sides of the feed pumps.

* * * * *